US005782195A

United States Patent [19]

Kobelt

[11] Patent Number: 5,782,195

[45] Date of Patent: Jul. 21, 1998

[54] BRAKING/REVERSING RUDDER FOR MARINE VESSEL

[76] Inventor: Jacob Kobelt, 1654 Ocean Park Road, Surrey, British Columbia, Canada, V4A 4V5

[21] Appl. No.: 674,677

[22] Filed: Jul. 2, 1996

[51] Int. Cl.[6] ..... B63H 25/06

[52] U.S. Cl. ..... 114/162; 114/150

[58] Field of Search ..... 114/150, 161, 114/162, 145 R; 440/61; 91/512, 382

[56] References Cited

U.S. PATENT DOCUMENTS

| | | | |
|---|---|---|---|
| 3,302,604 | 2/1967 | Stuteville | 114/150 |
| 3,335,688 | 8/1967 | Leigh | 114/150 |
| 3,530,766 | 9/1970 | Pilch | 91/512 |
| 4,172,571 | 10/1979 | Bowdy | 244/50 |
| 4,836,810 | 6/1989 | Entringer | 440/61 |
| 5,266,060 | 11/1993 | Onoue | 440/61 |
| 5,289,756 | 3/1994 | Kobelt | 91/368 |

FOREIGN PATENT DOCUMENTS

| | | | |
|---|---|---|---|
| 251297 | 11/1987 | Japan | 114/150 |
| 596499 | 3/1978 | U.S.S.R. | 114/150 |

OTHER PUBLICATIONS

KOBELT Publication, Model 7174 Rudder Angle Feed Back, 1989.

*Primary Examiner*—Ed L. Swinehart

[57] ABSTRACT

A rudder operating apparatus is for swinging a rudder of a marine vessel through approximately one-half of a revolution about a rudder axis for braking and/or reversing the vessel. The apparatus comprises an initiating actuator, a main linear actuator and a controller responsive to position of the rudder. The initiating actuator cooperates with the rudder to initiate movement of the rudder through a switching angle when the rudder is in a straight position thereof for straight line travel. The main linear actuator cooperates with the rudder and is extensible and retractable. The controller cooperates with the actuators to actuate the initiating actuator and the main actuator in sequence. The initiating actuator is actuated first to rotate the rudder through the switching angle when reactive forces from the water are low, after which the main actuator is actuated to apply additional force at an increasing mechanical advantage to generate sufficient torque to increase the rudder angle up to approximately 90 degrees from the straight position to provide a reversing force. Preferably, the initiating actuator is an extensible and retractable hydraulic linear actuator, and both actuators cooperate with at least one tiller arm extending from a rudder stock of the rudder.

30 Claims, 8 Drawing Sheets

BRAKING/REVERSING RUDDER FOR MARINE VESSEL

BACKGROUND OF THE INVENTION

The invention relates to a rudder apparatus for controlling angle of a rudder of a marine vessel, particularly an apparatus which can swing the rudder through approximately 90 degrees from the normal straight ahead aligned position so as to provide braking and/or reversing force to the vessel.

In many motorized marine vessels, a rudder is positioned aft of the propeller so as to be impinged by "prop-wash", that is water driven aft of the propeller. When the rudder is swung a few degrees from its straight ahead or aligned position, prop-wash impinging the inclined rudder is directed generally laterally, applying a turning force to the vessel. When the rudder is used only for turning the vessel, rudder angle is usually limited to about 30 degrees of rotation on either side of the straight ahead position. However, in some vessels, particularly European industrial barges, the rudder can be swung through about 90 degrees on either side of the aligned position and when inclined at 90 degrees to the aligned position, prop-wash is directed generally forwardly by the rudder, applying a braking force to the vessel, which if sustained for a sufficiently long time, can result in reversing the vessel at a slow speed.

Usually, the rudder is controlled by a tiller arm extending rigidly from a journalled rudder post which rotates with the rudder, and a single hydraulic cylinder extending between a hinge mounting on the vessel and the tiller arm. Usually, the tiller arm is aligned with the rudder and projects forwardly from the rudder post, and the hydraulic cylinder is disposed transversely of the tiller arm so as to apply a lateral force to the tiller arm when the rudder is aligned, thus providing an optimum mechanical advantage only when small rudder angles are required. As the rudder swings through 90 degrees from the aligned position to the braking position, geometry of the hydraulic cylinder connection with the tiller arm is such that the mechanical advantage of the cylinder acting on the tiller arm gradually decreases whereas a reactive force from water acting on the rudder increases, which is of course contrary to the force available from the hydraulic cylinder as above described. Thus, in a typical prior art braking/reversing rudder arrangement, as more force is required to be applied to the rudder as it swings to the braking position, less force is available from the hydraulic cylinder. Attempts have been made to alleviate these problems by providing a first hinged link having a slot engaged by a sliding pin of a second hinged link, but to the inventor's knowledge, such arrangements have not been adopted extensively.

It is known to use multiple hydraulic cylinders to apply steering forces to a steering unit, for example for steering a forward landing gear wheel of an aircraft as found in U.S. Pat. No. 4,172,571 (Bowdy). This patent discloses three trunnion-mounted hydraulic cylinders hinged at opposite ends thereof to be essentially parallel to each other when the nose wheel is straight ahead. When actuated, the cylinders swing through relatively large but differing angles as the nose wheel approaches its extreme angle of steering. It would appear that such an arrangement would not permit the wheel to swing through 90 degrees to the main longitudinal aircraft axis, as would be required for a marine rudder with reversing capabilities.

U.S. Pat. No. 3,302,604 (Stuteville) discloses a marine steering system in which a pair of hydraulic cylinders disposed generally transversely of a marine vessel cooperate with a single tiller to rotate the rudder. This provides a "follow-up" steering control mechanism which is for a different purpose than the present invention. Furthermore it is noted that the arrangement shown in this patent would not permit swinging of the rudder for reversing purposes through 90 degrees from the straight or aligned position.

SUMMARY OF THE INVENTION

The invention provides a marine steering assembly utilizing two hydraulic cylinders which cooperate with a rudder to move the rudder through about 90 degrees in either direction from the aligned or straight ahead position. The cylinders cooperate with a tiller arm at an optimum mechanical advantage as the rudder approaches a position at 90 degrees to the longitudinal axis of the vessel, whereby maximum torque is achieved to resist prop-wash and other reactive forces from the water. This overcomes the problem found in the prior art arrangement where a single transversely mounted steering cylinder applies a steering force which has a decreasing mechanical advantage against an increasing reactive force from water acting on the rudder.

A rudder operating apparatus according to the invention is for swinging a rudder of a marine vessel through approximately one-half a revolution about a rudder axis. The rudder operating apparatus comprises an initiating actuator, a main linear actuator and a controller. The initiating actuator cooperates with a rudder stock which controls the rudder. The initiating actuator is adapted to initiate movement of the rudder through a switching angle when the rudder is in a straight position thereof disposed generally parallel to a longitudinal vessel axis for straight line travel. The main linear actuator cooperates with the rudder stock and is extensible and retractible along a longitudinal axis which intersects the rudder axis when the rudder is in the straight position. The controller is responsive to position of the rudder and cooperates with the initiating actuator and the main actuator to actuate the initiating actuator and the main actuator in sequence to swing the rudder from the straight position thereof. In this way, to swing the rudder from the straight position thereof, the initiating actuator can be actuated first to rotate the rudder through the switching angle, at which position the main actuator can apply additional force to generate sufficient torque on the rudder to increase the angle of the rudder up to approximately 90 degrees from the straight position to provide a reversing force to the vessel.

Preferably, the tiller arm extends from the rudder stock within a generally vertical tiller plane containing the rudder axis and the rudder is located within a generally vertical rudder plane containing the rudder axis and being generally coplanar with the tiller plane. The initiating actuator is a linear actuator which is extensible and retractible along a longitudinal axis thereof. When the rudder is in the straight position, the longitudinal axis of the linear actuator is disposed at an initiating angle to the tiller plane which is sufficient to enable the initiating actuator to displace the rudder from the straight position thereof through to the switching angle. The controller further comprises a monitor responsive to angle of the rudder with respect to the longitudinal vessel axis, and a follower cooperating with the monitor to be responsive to the monitor, the follower having an output to actuate the initiating and the main actuator.

A detailed disclosure following, related to drawings describes several embodiments of the invention which is capable of expression in structure other than those embodiments particularly described and illustrated.

DETAILED DESCRIPTION

Figure 1:
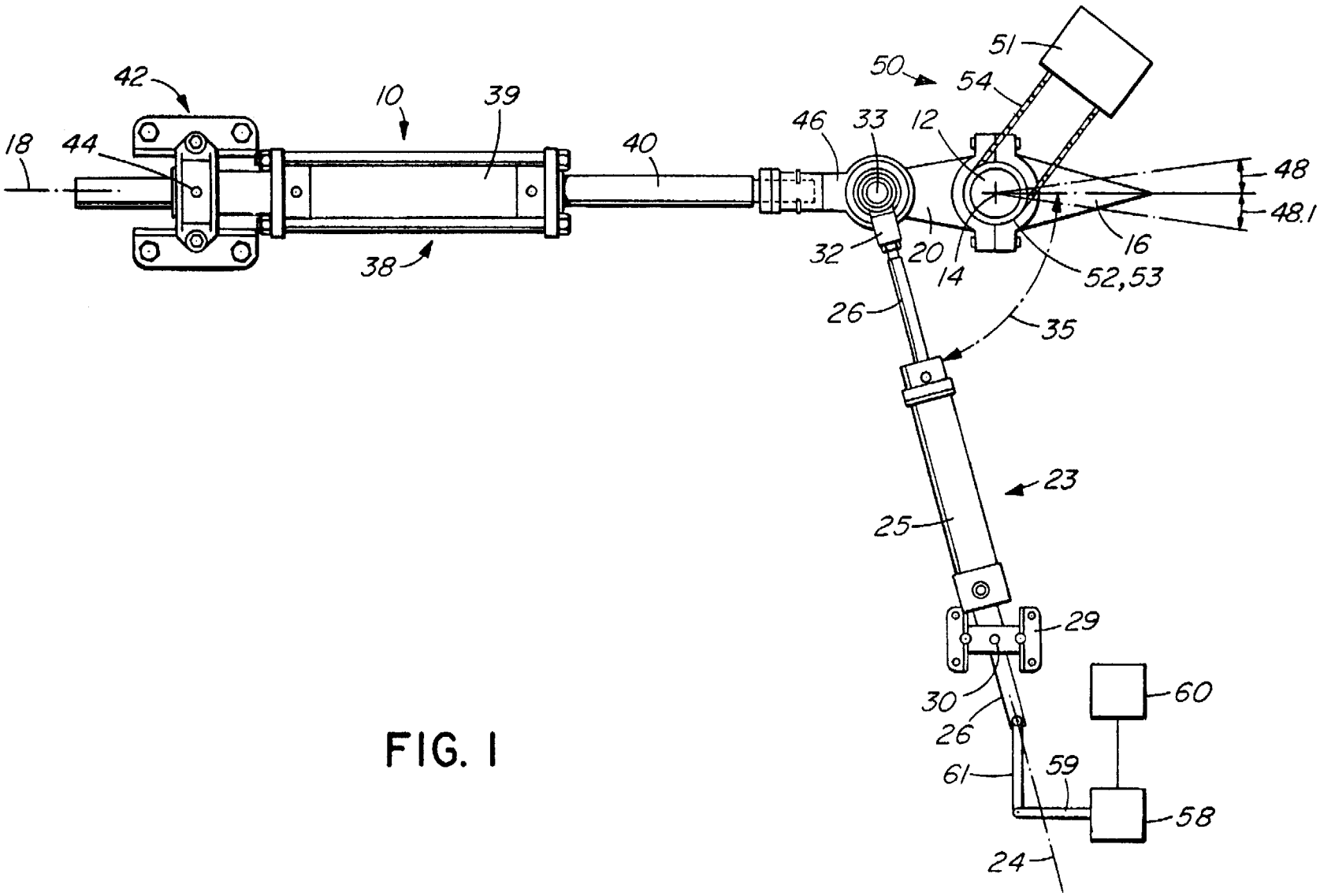
FIG. 1 is a simplified, fragmented partially diagrammatic top plan of a first embodiment of a rudder operating apparatus according to the invention shown with a chain driven controller, the apparatus being shown with the rudder disposed in a normal straight or aligned position parallel to the longitudinal axis of the vessel.
Figure 3:
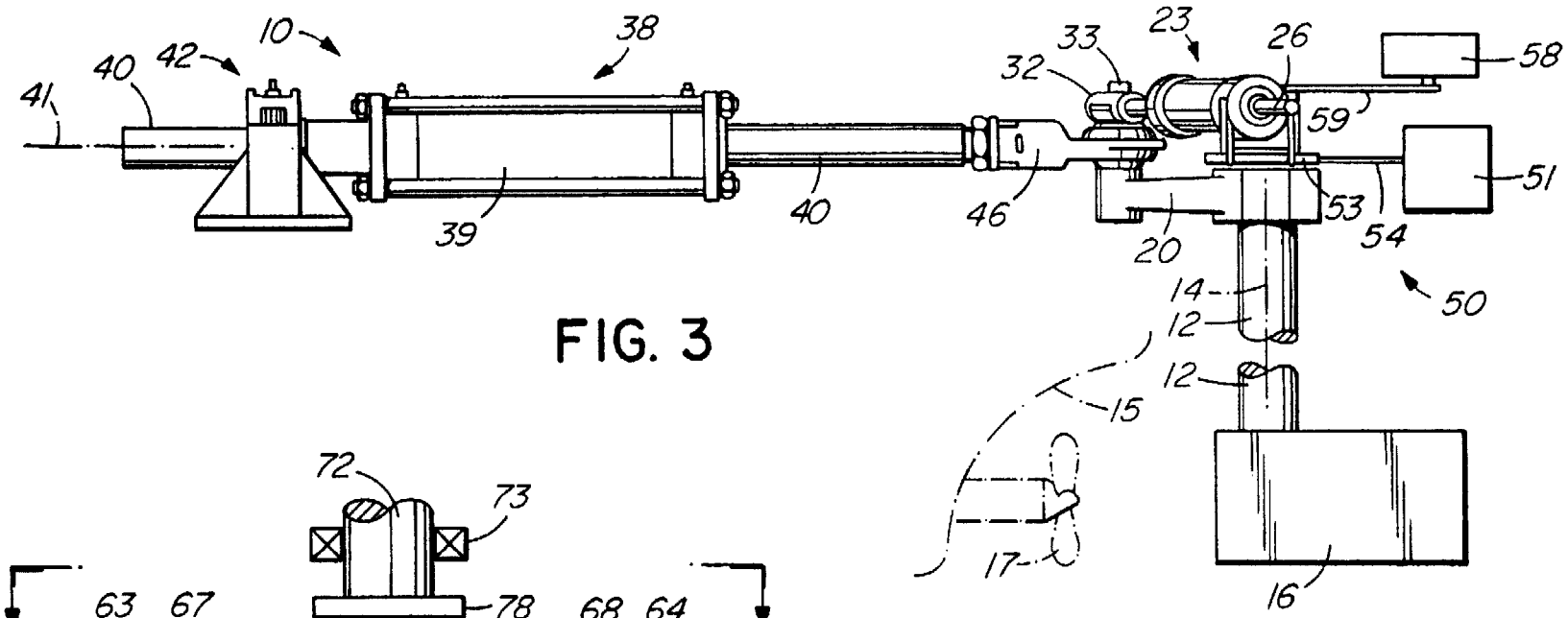
FIG. 3 is a simplified fragmented partially diagrammatic side elevation of the embodiment of FIG. 1.

FIGS. 1 and 3

A rudder operating apparatus 10 according to the invention is mounted on a marine vessel, not shown, having a rudder stock 12 which is mounted in stock journals, not shown, for rotation about a generally vertical rudder axis 14. The rudder stock is located adjacent a stern of the vessel which is shown partially in broken line at 15 in FIG. 3. The rudder stock 12 carries a conventional rudder 16 which is aligned with a longitudinal vessel axis 18 for straight line travel. A propeller 17 is located forwardly of the rudder to direct prop-wash, i. e. water, past the rudder for propulsion and steering purposes. A tiller arm 20 is clamped to an upper portion of the rudder post and extends forwardly in a vertical tiller plane containing a central axis of the tiller arm and the rudder axis 14 when the rudder is in the straight position as shown in FIG. 1, following conventional practise.

The apparatus 10 includes an initiating hydraulic cylinder 23 serving as an initiating linear actuator which is extensible and retractable along a longitudinal axis 24. The cylinder 23 comprises an initiating cylinder body 25 and a piston rod 26 extending through the body in both directions so as to provide a balanced action, that is equal and opposite rod displacement results from equal volume displacement on opposite sides of the piston mounted on the rod 26. The initiating cylinder body 25 is mounted on a hinge body mounting 29 so that the body is hinged for rotation about a generally vertical hinge axis 30, the hinge body mounting 29 being secured to a fixed portion of the vessel generally adjacent the stern. The piston rod 26 has an outer end with a rod journal 32 cooperating with a vertical tiller pin 33 extending from an outer end of the tiller arm 20, so that extension and retraction of the rod 26 rotates the tiller arm, and with it the rudder 16 about the axis 14. The axis 24 of the initiating cylinder is disposed at an initiating angle 35 to a vertical tiller plane containing a main axis of the tiller arm and the rudder axis, the plane not being shown. The initiating angle is typically between about 70 and 90 degrees and is selected to be sufficient to enable force from the initiating actuator to displace the rudder from the straight position thereof through a relatively small "switching angle" as will be described.

The apparatus 10 further includes a main cylinder 38 having a main cylinder body 39 and a piston rod 40 reciprocable relative thereto, the piston rod similarly extending in both directions from the body so as to provide balanced action similarly to the initiating cylinder. The main cylinder is a main linear actuator which is extensible and retractable along a longitudinal axis 41 which, when the rudder is aligned in the straight position as shown in FIG. 1, is within a vertical vessel plane containing the longitudinal vessel axis 18. Also, similarly to the initiating cylinder, the cylinder body 39 is mounted on a hinge body mounting 42 secured to the vessel so that the cylinder body is hinged for rotation about a generally vertical hinge axis 44 which is within the vessel plane. The piston rod 40 has a rod journal 46 which similarly cooperates with the tiller pin 33. As seen in FIG. 3, the rod journal 46 is positioned between the rod journal 32 and the arm 20, but the relative position of the rod journals is not critical. Similarly to the rod 26, extension and retraction of the rod 40 relative to the cylinder rotates the tiller arm, and with it the rudder about the axis 14. The rods are spaced vertically apart to provide clearance as the arm 20 swings through 180 degrees, that is 90 degrees on either side of the straight ahead position as shown in FIG. 1.

In the straight-ahead position as shown in FIG. 1, the tiller arm 20 and rod 40 are aligned with each other along the axis 18, i.e. the axis 41 of the main cylinder 38 intersects the rudder axis 14, and thus are "dead-centered". Thus, barring instability or a lateral disturbing force, actuator of the cylinder 38 likely would not result in any movement of the tiller arm or rudder. A lateral disturbing force is provided by the initiating cylinder 23 which, as will be described, displaces the tiller arm through a small angle, termed "switching angle", which is designated 48 and 48.1 on opposite sides of the axis 24. The angles 48 and 48.1 are sufficiently large to move the axes 14 and 41 sufficiently out of alignment to enable the main cylinder to apply adequate force to the tiller arm to generate sufficient torque on the rudder stock to rotate the rudder for further steering, or to approach an extreme 90 degree position to apply braking or reversing forces. The angles 48 and 48.1 are usually equal and relatively small, and preferably are about 5 degrees, but could be between about 2 degrees and 10 degrees. In the drawings herein, size of the switching angle is exaggerated for clarity.

Clearly, as the rudder angle increases, mechanical advantage of the main cylinder acting on the tiller arm also increases as the effective moment arm increases proportionately with the increasing rudder angle. This increasing force can overcome an increasing reactive force from the water as the rudder angle increases. In contrast, effective moment arm of the initiating cylinder decreases as the rudder angle increases, but this is not important as the initiating cylinder does not contribute materially to the steering torque as the main cylinder provides most of the force. The decreasing effective moment arm of the initiating cylinder is similar to prior art transversely mounted steering cylinders referred to previously. The main cylinder 38 also has a greater piston area than the initiating cylinder 23 and thus can generate considerably more force than the cylinder 23.

The apparatus further comprises a controller 50 which is responsive to position of the rudder and controls actuation of the initiating cylinder 23 and the main cylinder 38 as will be explained. The controller comprises a controller housing 51 and a monitor 52 which is responsive to angle of the rudder with respect to the longitudinal vessel axis 18. In this embodiment the monitor is mechanical and comprises a transmission device driven by the rudder stock 12 which carries a driver unit, which in this instance is a chain sprocket 53 secured to the rudder stock. The transmission device further comprises a loop of chain 54 passing around the sprocket 53 and transmitting rotation of the rudder to a driven unit within the controller housing 51 as will be described with reference to FIGS. 4 and 5.

The apparatus 10 further includes an optional rudder angle feedback unit 58 connected electrically to a visual monitor 60 mounted on the bridge of the vessel visual for displaying to an operator for monitoring of the rudder angle. The unit 58 has a hinged input arm 59 and a rigid connecting link 61 which extends from the input arm to an outer end of the piston rod 26 of the initiating cylinder 23. As the rod 26 moves along the axis 24, the arm 59 rotates due to the link 61 and provides an indication of the rudder angle with respect to the axis 18 as is well-known in the trade.

Figure 2:
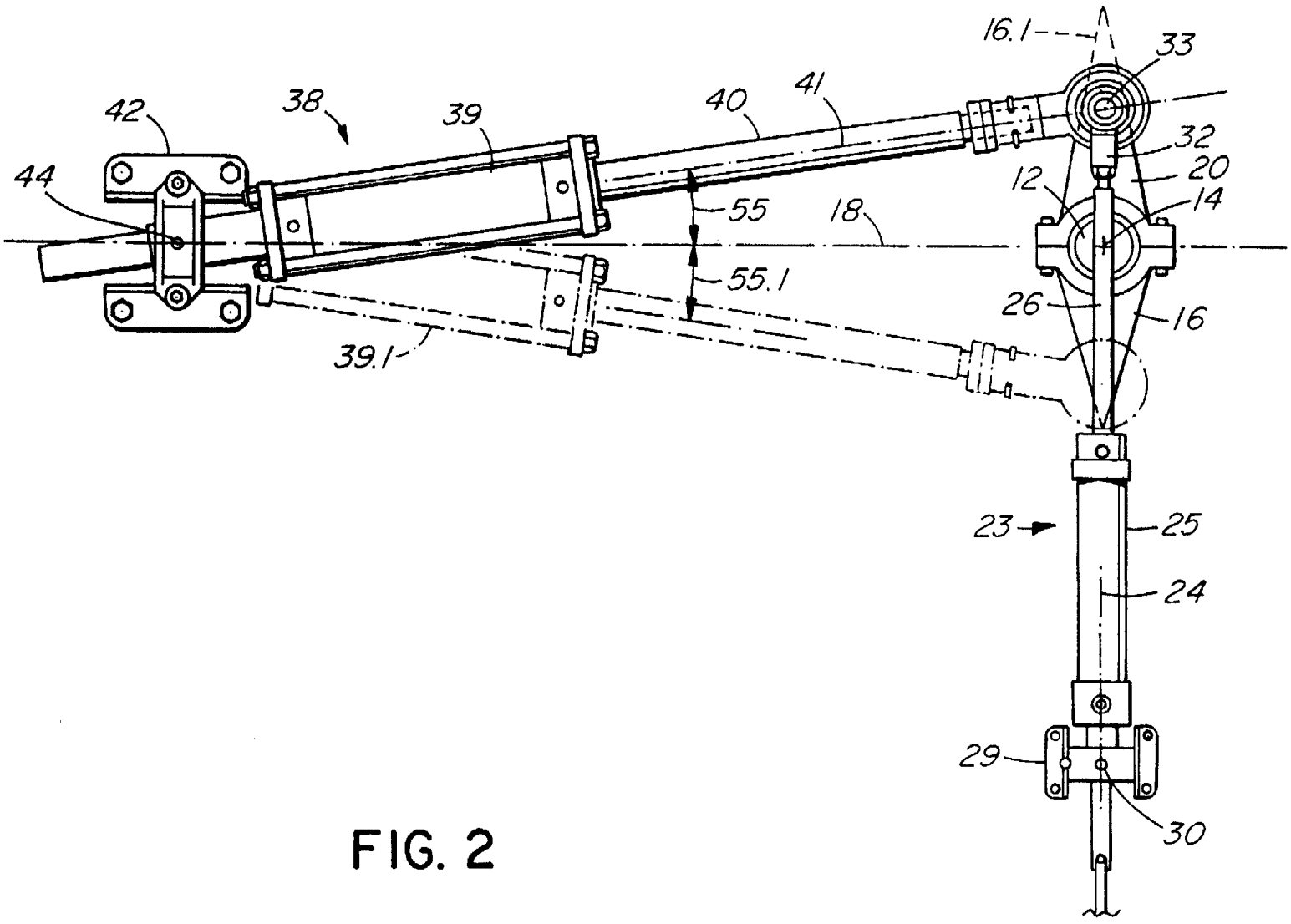
FIG. 2 is similar to FIG. 1 with the rudder shown swung through 90 degrees in a braking and/or reversing mode.

Referring to FIG. 2, the rudder 16 is shown in full outline in a braking/reversing position displaced 90 degrees from the aligned position as shown in FIG. 1. The main cylinder 38 is fully extended and inclined at a shallow angle 55 to the longitudinal vessel axis 18, and the tiller arm 20 is disposed at 90 degrees to the axis 18. To attain this position, the initiating cylinder 25 extends initially to attain the switching angle, and then becomes fully extended after the cylinder 38 becomes active, as will be explained. The rudder 16 is also shown in broken outline at 16.1 in an opposite second position also at 90 degrees to the axis 18, having swung in an opposite direction to that shown in full outline. In this opposite position, the cylinder 38 is again fully extended, but rotated about the axis 44 in an opposite direction through a similar angle 55.1. In contrast, the initiating cylinder 23 is shown fully retracted having initiated opposite rudder rotation towards the second position by retracting initially.

FIGS. 4, 5, 5A and 5B

Figure 4:
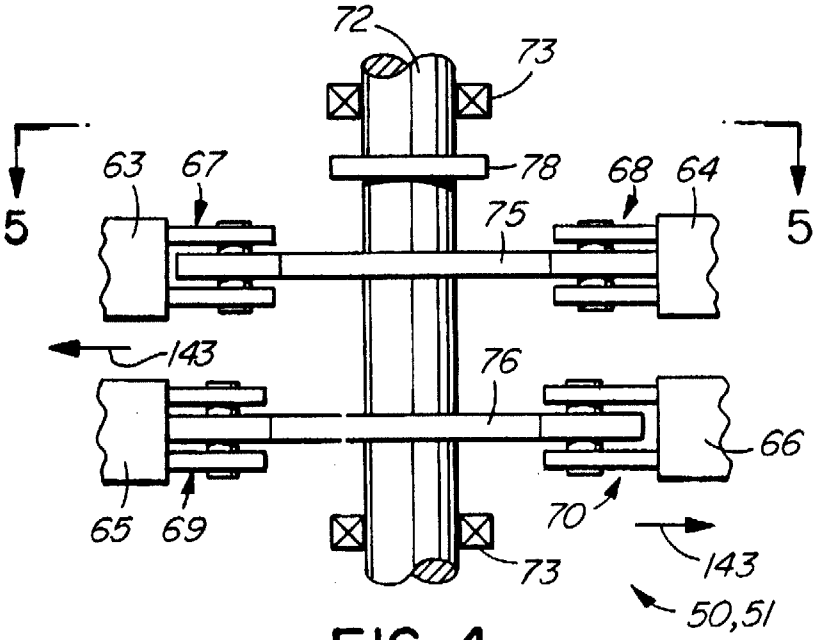
FIG. 4 is a simplified, fragmented side elevational diagram of the controller used in FIGS. 1 through 3.

Referring mainly to FIG. 4, the controller housing 51 provides a mounting for a control valve device comprising four generally similar directional valves 63, 64, 65 and 66 which are shown fragmented and are actuated by resiliently mounted actuating plungers 67, 68, 69 and 70 respectively. The controller 50 further comprises a cam shaft 72 journalled for rotation in cam shaft bearings 73 and carrying first and second cams 75 and 76 respectively which are thus concurrently rotatable. The actuating or upper plungers 67 and 68 engage surfaces of the cam 75 and the actuating or lower plungers 69 and 70 engage the second or lower cam 76, which, when the cam shaft rotates, move the respective plungers which function as cam followers and have undesignated rollers as is well known. Thus, the plungers 67 and 68 actuate a diametrically opposite pair of directional valves 63 and 64 and are controlled by the first cam 75, and the plungers 69 and 70 actuate a similar second pair of directional valves 65 and 66 and are controlled by the second cam 76, the particular valves to be actuated depending upon the direction of rotation of the cams as will be explained. A sprocket 78 is secured to the cam shaft 72 and engaged by the chain 54 (see FIG. 1) so as to rotate the cam shaft at the same speed as the rudder stock, i.e. to be in phase with the rudder stock 12 to reflect the position of the rudder.

Figure 5:
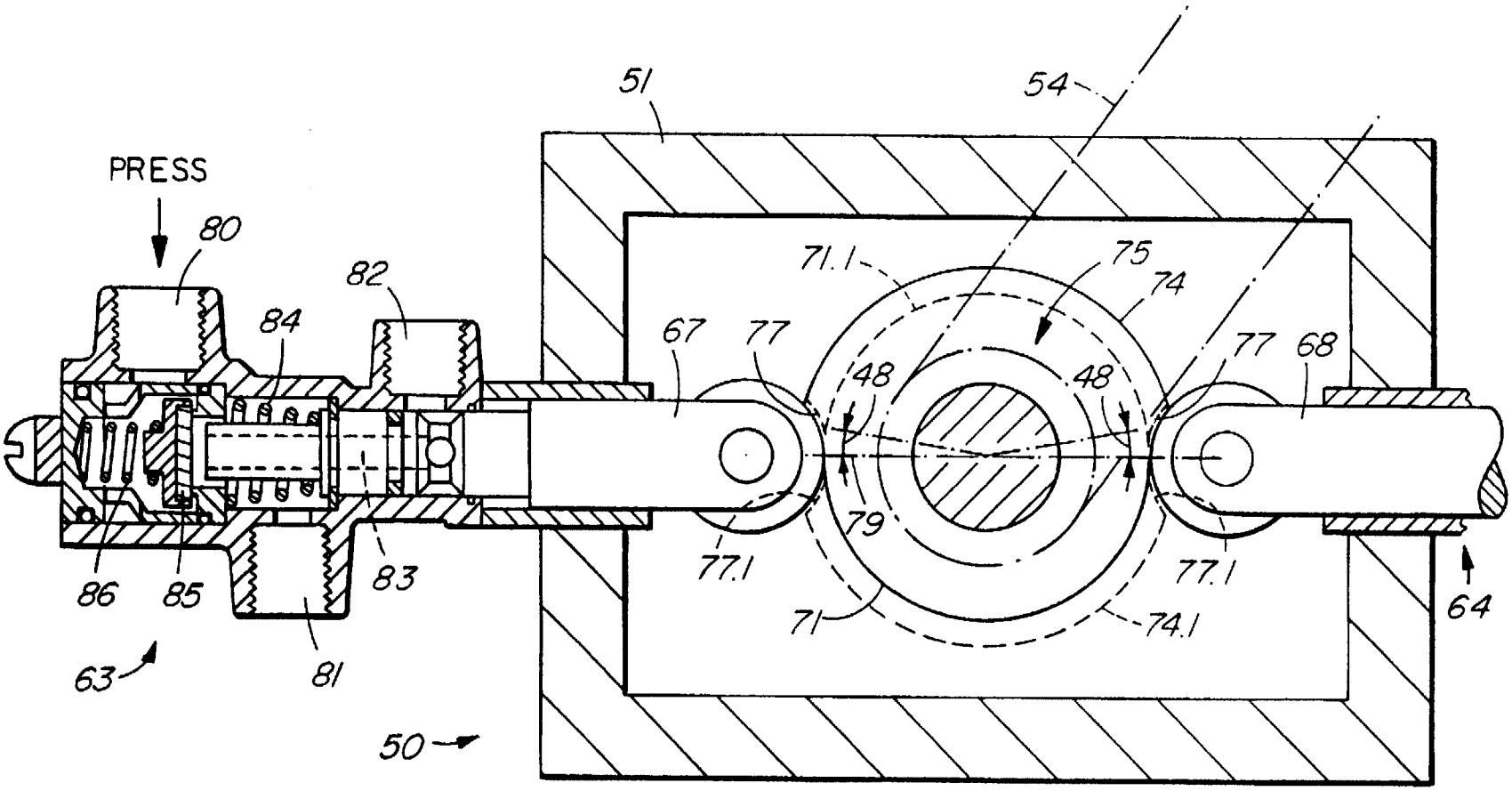
FIG. 5 is a simplified, fragmented diagrammatic section of the controller, as seen from Line 5—5 of FIG. 4 with cam structure reflecting a straight aligned rudder position, and also showing internal details of one type of valve.
Figure 5B:
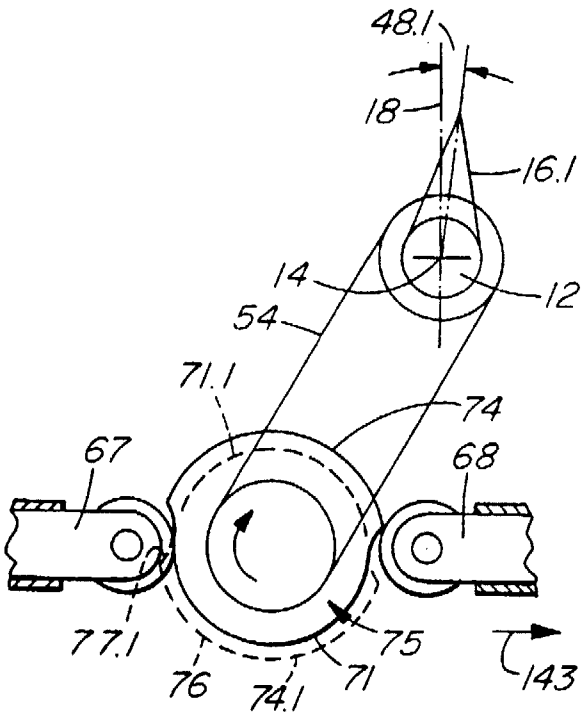
FIGS. 5A and 5B are simplified diagrams showing the cam structure of FIG. 5 reflecting the rudder disposed at switching angles on opposite sides of the longitudinal axis.
Figure 5A:
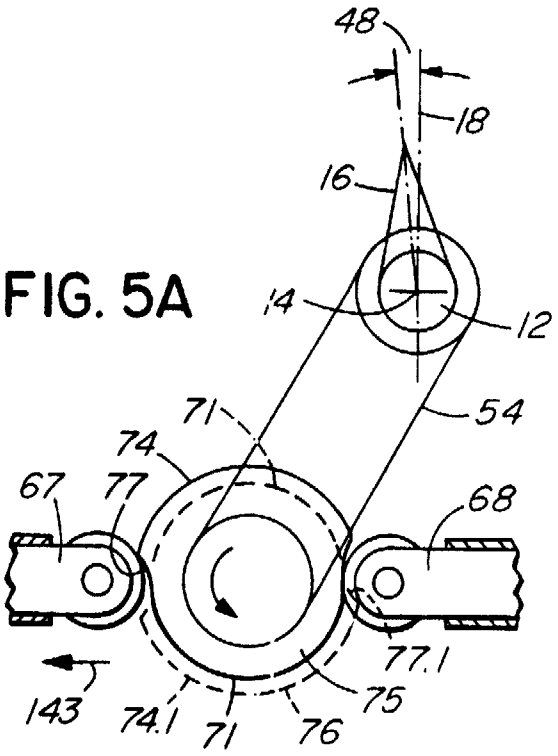

Referring to FIG. 5, the cams 75 and 76 are identical and thus serve as similar cam devices and only cam 75 will be described in detail. The cam 75 has initiating and main cam surfaces 71 and 74 respectively spaced generally diametrically apart and intersecting on a diameter 79 which is aligned with the plungers as shown when the rudder is straight ahead. In this position, both plungers 67 and 68 are fully extended as shown. The cam surfaces 71 and 74 are separated by similarly shaped but oppositely facing switching zones 77, each of which has a radius generally equal to the roller of the plunger. The switching zones are circumferentially spaced apart but located on the same side of the diameter 79 and thus are not diametrically opposed to each other. Each switching zone extends generally from ends of the diameter 79, which intersects the initiating surface 71, to a switching point (not shown) which is phased with respect to the rudder at the respective switching angles 48, 48.1 of the rudder, see FIG. 1. The switching point is not necessarily on the surface 74 and is dependent on the type of valve and represents a change-over or switching position of the valve as will be described. The cam surfaces 71 and 74 are essentially semi-circular, less a few degrees of circumference required for the two switching zones 77, the surface 71 having a radius which is less than radius of the surface 74. Thus, as the cam shaft rotates, if the cam follower engages one or other of the cam surfaces 71 or 74, there is no change in signal to the valves until the plunger engages a switching point. However, as the rudder swings from the aligned position through the switching angle, contact between the cam follower and the cam surfaces shifts quickly from the initiating cam surface 71 to the main cam surface 74 as follows. In FIG. 5B, the cam 75 rotates clockwise, the plunger 68 is retracted by the adjacent switching zone 77, and the plunger 67 remains extended. Similarly, in FIG. 5A, the cam 75 rotates anti-clockwise, the plunger 67 is retracted and the plunger 68 remains extended. Thus, one particular plunger of a pair of plungers is retracted or remains extended depending on the direction of rotation of the cam shaft.

In FIGS. 4 and 5, the cam 76 has an essentially identical shape to the cam 75 and has similar initiating and main cam surfaces 71.1 and 74.1 respectively, separated by similar switching zones 77.1 all of which are shown in broken outline for clarity. The main cam surface 74.1 is located generally on the same side of the shaft 72 as the initiating surface 71, and the main cam surface 74 is located generally on the same side as the shaft 72 as the initiating surface 71.1. The switching zones 77.1 of the cam 76 are both located on a side of the diameter 79 oppositely to the zones 77 of the cam 75 and have similar switching points, each point being phased at the switching angle with respect to the rudder. The cams 75 and 76 are each phased in a specific relationship to the rudder through the transmission means so that the four switching points of the two cams are phased with respect to the rudder at the appropriate switching angles which are disposed symmetrically relative to the diameter 79, at opposite ends thereof and on opposite sides thereof. The cam followers of one cam are located within the housing 51 to be aligned axially with the adjacent cam followers of the other cam so as to engage the appropriate switching zones of the cam surfaces simultaneously. FIG. 5 shows the roller of a particular plunger is complementary to the aligned switching zones on the two cams. In this way, as the rudder swings from the straight ahead position to port or to starboard and attains either of the switching angles, a specific cam follower of each pair of valves engages the respective switching point, thus actuating two valves simultaneously (i.e. one of each pair) while the remaining two valves are unchanged.

Referring again to FIG. 5A, the rudder 16 is shown swung to starboard through the switching angle 48, and the first cam 75 has been shown correspondingly rotated anticlockwise through a similar angle so that the plunger 67 has been retracted per the arrow 143 by the switching zone 77. In contrast, the roller 68 remains extended as the transition zone has moved away therefrom. However, it can be seen that the switching zone 77.1 of the lower cam 76 would displace the lower plunger 66, positioned below the plunger 68, see FIG. 4.

Referring again to FIG. 5B, the rudder is shown swung through the switching angle 48.1 to port at position 16.1 causing the first cam 75 to rotate the same amount to retract the plunger 68 per arrow 143, while the plunger 67 remains extended. Clearly, in this position, the lower plunger 69, see FIG. 4, would be retracted by the switching zone 77.1 on the cam 76.

The appropriate valve of each cam thus shifts simultaneously as the switching zones pass the respective cam followers which occurs very quickly during only a few degrees of rotation of the cam shaft.

Referring again to FIG. 5, the directional valve 63 is typical of the four valves and is a three-way valve with inlet, outlet and return ports 80, 81 and 82 respectively which are coupled to conduits as will be described with reference to FIG. 6. The inlet port 80 is located farthest from the cam shaft, the return port 82 is located closest to the cam shaft, and the outlet port 81 is located between the inlet and return ports. Flow through the ports is controlled by the actuating plunger 67 which has a central passage 83 and is spring urged by a first spring 84 to extend outwardly from the housing which reflects the position when the plunger 67 engages the initiating cam surface 71. The directional valve 63 has a valve member 85 which, when clear of an inner end of the plunger 69, is forced against a complementary undesignated valve seat by a second spring 86. This position is the extended position in which the inlet port 80 is closed, but fluid can pass between the outlet port 81 and the return port 82 through the central passage 83 in the plunger. In contrast, when the plunger 69 engages the main cam surface 74, the plunger is retracted into the housing against force from the spring 84, and the inner end of the plunger displaces the valve member 85 off its undesignated valve seat, thus opening the inlet port 80 to pass pressurized fluid into the inlet port and out through the outlet port 81. When the plunger is retracted the passage 83 is closed by the valve member 85, and thus the return port 82 is closed.

Thus, in summary, the valve 63 is a two-position, three-way normally closed valve, in which when the plunger is extended by the spring 84, i.e. the valve is in an inactivated or normal state, the inlet port is closed but there is communication between the outlet and return ports which are open. Also, when the plunger 69 is retracted, the valve is activated and the inlet port is open, the return port is closed, and there is communication between the inlet port and the outlet port. Clearly, many other arrangements of valves and cams can be devised to attain a particular sequence of ports opening and closing to attain an equivalent valve logic as will be described. The terms "inlet", "outlet" and "return" referring to the ports refers to flow direction relative to the port only when the valve is activated, that is when the valve plunger has been retracted and the inlet port is open to receive pressurized fluid, and the outlet port discharges the fluid. When the valve is inactive, that is the plunger is extended and the inlet port is closed, fluid can flow in either direction between the outlet and return ports.

The switching angle 48, 48.1 is as small as possible to enable initial movement of the rudder to shift the longitudinal axis 41 of the main cylinder to be non-aligned with the rudder axis 14 so as to enable the main cylinder to be actuated to apply an ever-increasing torque to the rudder. The valves are located with respect to the cam shaft to permit fine switching adjustment to ensure simultaneous actuation of the valves of each pair of valves to provide symmetrical and smooth valve actuation. As will be described, when the rudder is straight the main cylinder cooperates with the tiller arm at what is effectively a "dead center position", and thus a negligible amount of fluid is displaced by the main cylinder while the rudder moves through the relatively small switching angle. For any configuration, all the directional valves are essentially exposed to tank and thus any small amount of fluid displaced by the main cylinder 38 does not generate a hydraulic lock because there is sufficient tolerance in the circuit to accommodate a relatively small amount of fluid displaced relative to the cylinder 38 as the rudder passes through the switching angle. While a particular type of three-way, two-position valve has been illustrated, any commercial spool valve functioning in an equivalent manner could be substituted.

FIG. 6

The rudder operating apparatus 10 is usually powered and controlled by a conventional hydraulic pump 95 and steering valve 96. As is well know, for emergency use only, it is common to also provide a conventional helm pump 88 which has fluid ports which receive or discharge fluid depending on the direction of rotation of the helm pump. Lines 91 and 92 extend from both pumps to ports 93 and 94 respectively at opposite ends of the cylinder 23. Lines 97 and 98 extend from ports 99 and 100 at opposite ends of the cylinder 23 and communicate with one way check valves 101 and 102 respectively in lines 103 and 104 which in turn both communicate with the directional valves as shown. As described with reference to FIG. 5, the valve 63 has the inlet, outlet and return ports 80, 81 and 82 controlled by the plunger 67, and the axially aligned adjacent lower valve 65 has similar inlet, outlet and return ports 110, 111 and 112 controlled by a similar plunger 69. Similarly, the diametrically opposite upper valve 64 has inlet, outlet and return ports 117, 118 and 119 controlled by the plunger 68, and the axially aligned adjacent lower valve 66 has inlet, outlet and return ports 120, 121 and 122 controlled by the plunger 70.

The line 103 extends from the check valve 101 to communicate with the return ports 112 and 122 of the valves 65 and 66 respectively, and the line 104 extends from the check valve 102 to communicate with the return ports 82 and 119 of the valves 63 and 64 respectively. A line 137 extends from the inlet line 97 in parallel with the valve 101 to communicate with the port 80 of the valve 63, and a line 138 extends from the line 137 and communicates with the inlet port 117 of valve 64. Similarly, a line 139 extends from the line 98 in parallel with the check valve 102 and communicates with the inlet port 110 of the valve 65, and a line 140 extends from the line 139 and communicates with the inlet port 120 of valve 66.

The apparatus further includes first and second two-way check valves 125 and 126 which communicate with ports 129 and 130 at opposite ends of the main cylinder 38. The valve 125 has oppositely located ports for controlling flow in lines 133 and 134 extending from the outlet ports 121 and 118 of the valves 66 and 64 respectively. Similarly, the two-way check valve 126 has oppositely located ports to control flow in lines 135 and 136 extending from the outlet ports 111 and 81 of the valves 65 and 63 respectively.

Operation

Figure 6:
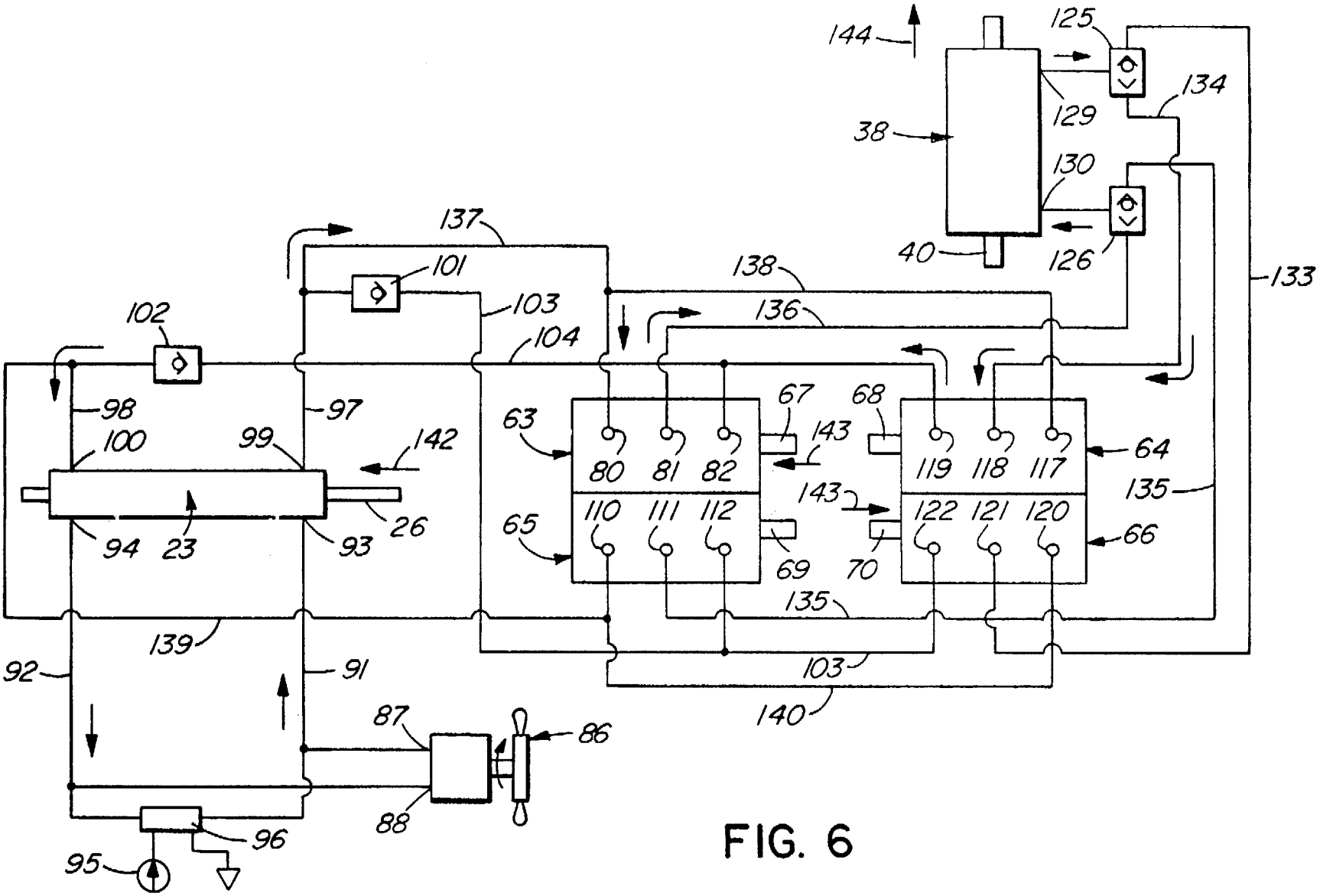
FIG. 6 is a simplified hydraulic schematic of the hydraulic components of the invention showing four three-way directional valves for controlling fluid flow relative to two hydraulic cylinders.

Referring mainly to FIG. 6, for steering in one direction, fluid flows from the pump along the line 91 into the cylinder 23, and fluid returns to the pump along the line 92 from the cylinder 23. Initially, when the rudder is aligned straight, the check valves 101 and 102 and the inlet ports 80, 110, 117 and 120 of the valves 63, 65, 64 and 66 respectively are closed, and thus for normal operation fluid is confined to a simple circuit comprising the cylinder 23 and the valve 96, and the pump 95. Fluid flowing into the port 93 displaces the rod 26 in direction of the arrow 142, which in turn initiates movement of the rudder from the straight ahead position while fluid is returned to the pump. As the rudder rotates, the sprocket 53 on the rudder stock 12 rotates, which, through the chain 54 also rotates the sprocket 78 within the controller housing 51 (FIGS. 4 and 5). Rotation of the sprocket 78 moves the first and second cams 75 and 76 which initially has no effect on the plungers 67, 68, 69 and 70, all of which engage the respective initiating cam surfaces.

However, referring also to FIGS. 4 and 5, when the tiller arm and thus the rudder have moved through the switching angle 48, the switching points of the cams 75 and 76 actuate, i.e. retract, the plungers 67 and 70 essentially simultaneously as shown by arrows 143 in FIG. 4 to actuate the directional valves 63 and 66. The plungers 68 and 69 of the valves 64 and 65 remain unchanged, that is extended. Thus the inlet ports 80 and 120 of the valves 63 and 66 are opened while the inlet ports 117 and 110 of the valves 64 and 65 remain closed. This enables fluid from the port 99 to pass through the line 137 to enter the inlet port 80, while flow in the line 138 is prevented by the closed port 117 of the valve 64. Fluid entering the port 80 leaves the valve 63 by the outlet port 81 and flows along the line 136 to the check valve 126 and into the port 130 of the main cylinder 38. This causes the piston rod 40 to extend per arrow 144, with fluid in the cylinder 38 being displaced from the port 129 to the valve 125. The line 133 is closed by the port 121 of the valve 66, and thus fluid leaves the valve 125 through the line 134 to enter the outlet port 118 of the valve 64 which is open because the valve 64 is inactivated. Fluid leaves the valve 118 through the inlet port 119 and passes along the line 104, through the check valve 102 and into the port 100 of the initiating cylinder 23. Fluid leaves the port 94 of the cylinder 23 and returns to the pump through the line 92.

Thus, when the switching angle has been exceeded, fluid enters and leaves the initiating cylinder 23 through appropriate ports, and the rod 26 continues to extend in the direction of arrow 142, applying a force to the tiller arm. Simultaneously, the rod 40 of the main cylinder 38 is also applying a force to the tiller arm. As is well known, to shift the rudder from an aligned position slightly to either side requires very little force as the angle 35 of the initiating cylinder inclined to the tiller arm provides an effective mechanical advantage. This low force results in relatively low pressure in the cylinder 23, and thus initially relatively low force is available from the initiating cylinder because it operates at a relatively low pressure. However, as the angle of the rudder increases much beyond the switching angle, the amount of force required to increase the rudder angle proportionately increases, which in turn increases pressure within the initiating cylinder. As operating pressure throughout the whole system is essentially equal, pressure in the main cylinder 38 equals pressure in the initiating cylinder 23 and thus pressure in the cylinder 38 also increases.

Because the cylinder 23 has a much smaller cross sectional area than the cylinder 38, maximum force available frqm the cylinder 23 is considerably less than that available from the cylinder 38. In addition, as the rudder angle increases, mechanical advantage of the cylinder 23 acting on the tiller arm 20 steadily decreases, thus further reducing torque available to the rudder from the initiating cylinder. In contrast, as the rudder angle increases from the straight ahead position, torque available from the main cylinder 38 increases, gradually attaining a maximum force as the tiller arm and thus the rudder approach 90 degrees to the longitudinal axis.

To return the rudder to the straight aligned position from an angle greater than the switching angle, direction of fluid flow in the lines 91 and 92 is reversed by the valve 96 so that fluid now leaves the pump along the line 92 and returns to the pump along the line 91, i.e. in an opposite direction to the arrows. Thus, fluid leaves the initiating cylinder 23 through the port 100 and passes along the lines 98, 139 and 140 to the inlet port 120 of valve 66, because the inlet port 110 of valve 65 is closed. Fluid leaves the valve 66 through the outlet port 121 and flows through the line 133 into the two-way check valve 125 and into the port 129 of the main cylinder 38. This shifts the piston rod 40 in a direction opposite to the arrow 144, which displaces fluid through the port 130, and into the two-way check valve 126. Fluid leaves the valve 126 through the line 135 and enters the outlet port 111 of the valve 65 and leaves via the return port 112 into the line 103. The check valve 101 opens and admits fluid into the line 97, through the ports 99 and 93 of the cylinder 23 and back into the line 91. The rod 40 continues to move in a direction opposite to the arrow 144 until the switching angle is reached. When the switching angle is reached the valves 63 and 66 are deactivated and the inlet ports thereof are closed and the fluid is then constrained to a circuit of the initiating cylinder 23 and the pump. When the rudder moves in the opposite direction beyond the switching angle, the valves 64 and 65 are actuated by retracting the plungers 68 and 69 respectively the valves 63 and 66 remain extended and de-activated while a generally opposite fluid flow sequence is followed.

In summary, it can be seen that the controller 50 is responsive to position of the rudder and cooperates with the initiating actuator and the main actuator to actuate the initiating actuator and main actuator in sequence to swing the rudder from the straight position thereof to an angled position for steering or braking or reversing. Also, the monitor is mechanical and is a cam device responsive to angle of the rudder stock and the follower is a cam follower assembly, namely the plungers 67 through 70 cooperating with the cams 75 and 76 to reflect position of the rudder stock. In order to swing the rudder from the straight position, the initiating actuator is actuated first to rotate the tiller arm and thus the rudder through a switching angle. Initial force applied by the initiating actuator can be relatively low as the force is applied at an adequate mechanical advantage and reactive forces generated by the water are low, but this mechanical advantage decreases as the rudder angle increases. At the switching angle 48 the main actuator is actuated to apply additional force to the tiller arm which is applied at a mechanical advantage which gradually increases as the rudder angle increases. In addition, as the reactive force generated by the water on the rudder increases, overall fluid pressure in the system increases which increases available force from the main cylinder, as well as from the initiating cylinder. Thus, the main cylinder can apply sufficient torque to the rudder to increase the rudder angle up to approximately 90 degrees from the straight position to provide a reversing force to the vessel.

Alternatives

The initiating actuator is shown as a hydraulic cylinder and this is the preferred type of actuator as it can be easily controlled with essentially conventional valves and hydraulic fluid is already available for the main actuator. Because pressure within the initiating cylinder is proportional to reactive force generated by the water, reactive force experienced by the initiating cylinder determines, within limits, overall pressure for the system, which results in a gradually increasing pressure throughout the system as the rudder angle increases, which in turn results in an increasing force from the main cylinder 38. However, in some circumstances it may be preferable to replace the hydraulic initiating linear actuator with a non-linear actuator actuated hydraulically, pneumatically, mechanically or electrically, or alternatively a mechanically actuated linear actuator or electrically actuated linear actuator can be substituted to eliminate the initiating cylinder 23. In any event, whatever type of initiating actuator is used, the switching angle is relatively small to ensure that the main cylinder can provide a steadily increasing force on the tiller arm, resulting in a steadily increasing torque to move the rudder from the switching angle to attain, if necessary, the 90 degrees braking position in which maximum torque is required.

The controller housing 51 is located remotely from the rudder stock for assembly and servicing convenience as there is usually insufficient space around the rudder stock to accommodate valves and plumbing necessary to actuate the actuating cylinder and main cylinder. However, in some installations sufficient space may be available adjacent the rudder stock to mount first and second cams thereon and to locate the directional valve closely adjacent the cams so be actuated directly by cams on the rudder stock, thus eliminating the chain and sprockets.

While the cam device is shown comprising the two cams 75 and 76, a single cam could be substituted for the two cams. In this alternative the four three-way valves 63 through 66 of the control valve device would be eliminated and two four-way valves substituted. This alternative can be more difficult to "fine-tune" the valve timing than the embodiment shown.

The structure disclosed is primarily mechanical and hydraulic, and if required electrical alternatives could be substituted as follows. The cam shaft can drive modified cams which are engaged by followers of electrical switches which in turn control electrically actuated fluid directional valves connected to the electrical switches and cooperating with the initiating and main fluid actuator cylinders to control fluid flow relative to the cylinders in a manner similar to the valve schematic of FIG. 6. Alternatively, the rudder angle feedback unit 58 of FIG. 1 can also be used as a feedback signal generator which cooperates with the initiating cylinder, and thus with the rudder, to reflect angle of the rudder with respect to the vessel longitudinal axis. In this alternative a feedback signal receiver will be provided to cooperate with the feedback signal generator and the initiating and main linear actuators to control actuation of the actuators.

In preferred and alternative embodiments, the controller comprises a rudder position output device which reflects position of the rudder with respect to the vessel longitudinal axis, and a fluid control valve which is actuated by the rudder position output device. Clearly, in any alternative, variations are possible to provide a means to actuate the main actuator after the rudder has attained the switching angle. Similarly to the chain driven cam shaft, if the fluid control valve is located remote from the rudder stock, the monitor would include a transmission device driven by the rudder stock, the transmission device comprising a driver unit responsive to the rudder stock, and a driven unit having a cam device reflecting movement of the rudder stock. For simplicity, if the monitor is mechanical, the driver unit can be a sprocket secured to the rudder stock and the driven unit can be a sprocket secured to the cam shaft with the loop of chain engaging the sprockets to transmit rotation from the rudder stock to the cam shaft.

FIG. 7

An alternative vessel, not shown, has first and second rudders 151 and 152, shown fragmented, spaced equally apart on opposite sides of a longitudinal vessel axis 154. The rudders 151 and 152 are thus twin rudders secured to rotate with respective first and second rudder stocks 157 and 158. First and second tiller arms 161 and 162 extend aft from the rudder stocks as shown, and are within planes containing axes of the rudders 151 and 152 respectively. The apparatus 150 further includes generally parallel first and second main hydraulic cylinders 165 and 166 which serve as first and second main linear actuators which are extensible and retractable along first and second longitudinal axes 167 and 168 respectively. The axes 167 and 168 are generally parallel to the vessel axis 154 and disposed generally within first and second tiller planes and parallel to the vessel axis 154 when the rudders are in the straight position thereof.

The apparatus 150 further includes a single initiating cylinder 170 which has a cylinder body 171 secured to the vessel and disposed symmetrically and perpendicularly of the vessel axis 154. The cylinder 170 has a piston rod 173 which extends from each end of the cylinder body 171 to provide a balanced cylinder, and the rod 173 has first and second ends 175 and 176. First and second connecting links 179 and 180 have respective undesignated inner and outer ends, the first and second inner ends being connected to the first and second ends 175 and 176 of the piston rods, and first and second outer ends being connected to the first and second tiller arms 161 and 162 respectively.

In operation, it can be seen that actuation of the initiating cylinder 170 moves the connecting links 179 and 180 in generally similar directions so as to apply forces to the first and second tiller arms 161 and 162, and thus to the first and second rudders. The tiller arms swing through essentially similar angles in the same direction to maintain the rudders 151 and 152 generally parallel to each other.

Figure 7:
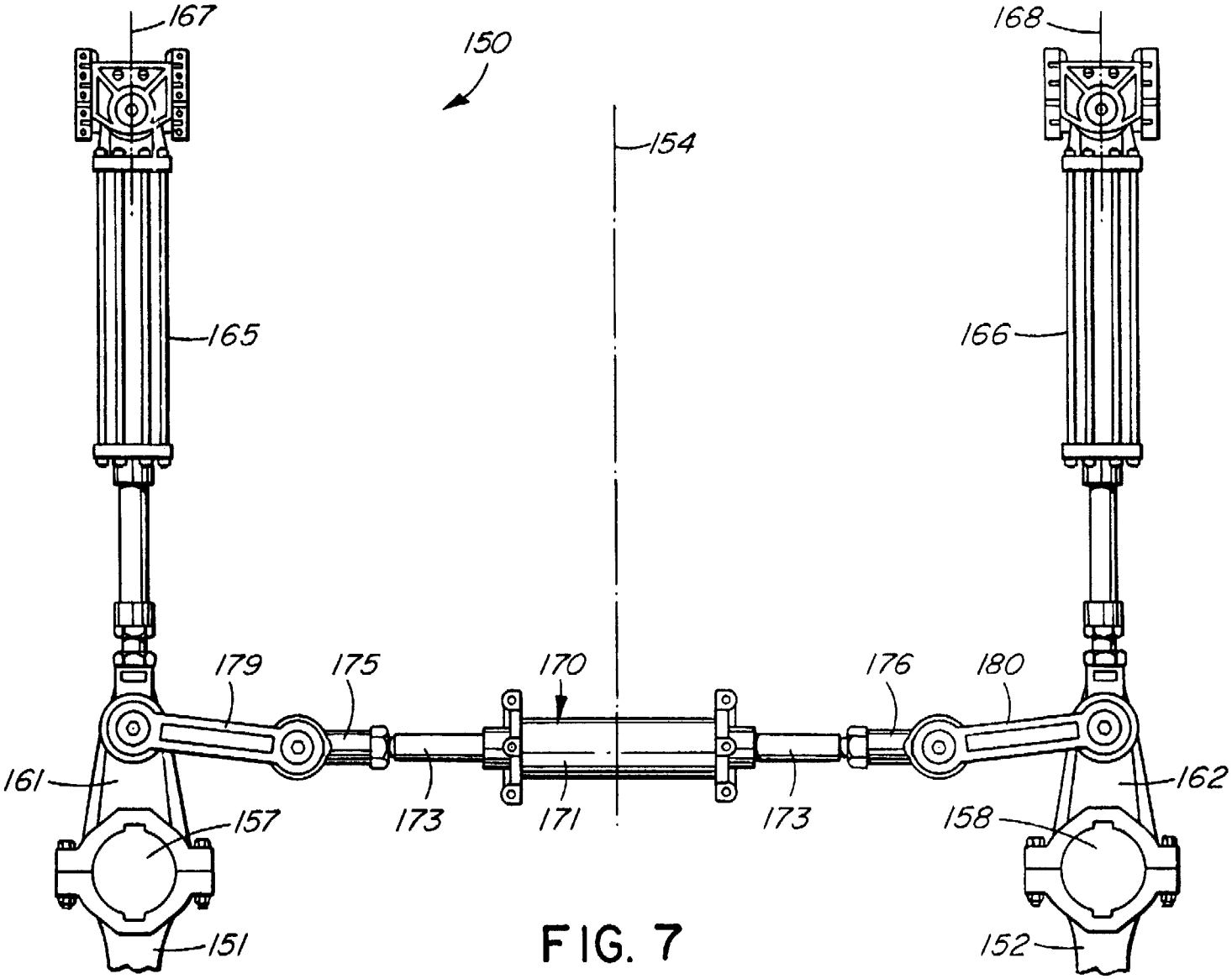
FIG. 7 is a simplified top plan of a second embodiment of the apparatus as used in a twin rudder embodiment.

In an alternative, not shown, opposite ends of the piston rod 173 could be fixed to the vessel, and the initiating cylinder body could move with respect to the piston rod 173, with the connecting links cooperating with opposite ends of the cylinder body 171, or other locations on the body 171. Alternatively, two similar initiating cylinders could be located between the two main cylinders and facing in opposite directions. The two initiating cylinders would be disposed at angles to the main cylinders generally similar to the arrangement shown in FIG. 1, thus duplicating a single cylinder arrangement and eliminating the connecting links 179 and 180 of FIG. 7.

Figure 10:
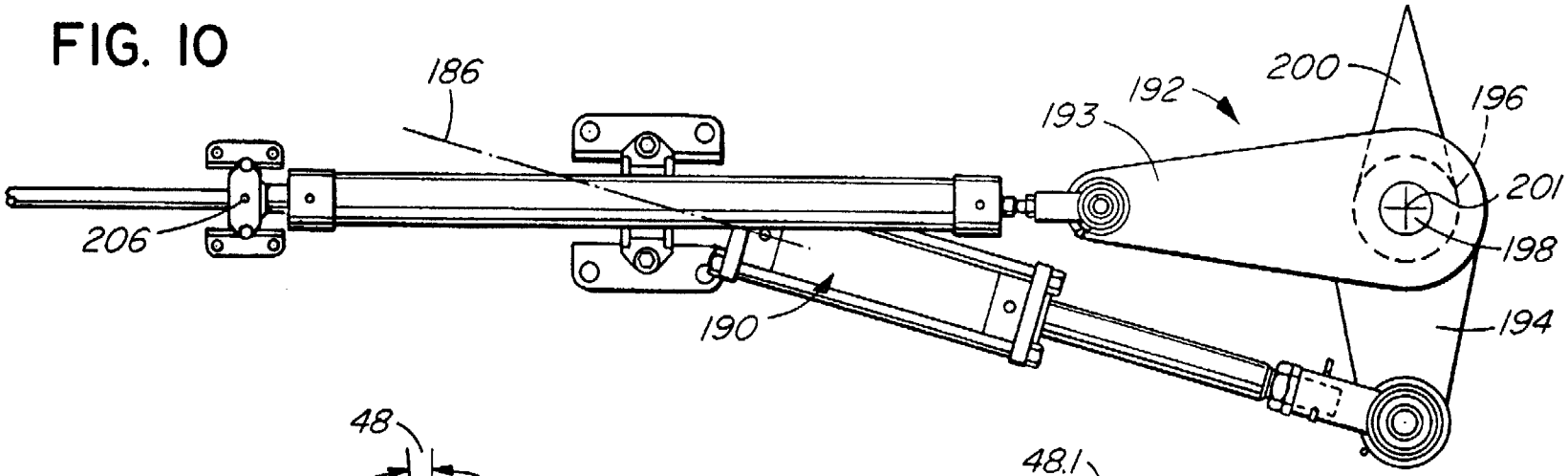
FIG. 10 is a simplified top plan of the third embodiment generally similar to FIG. 8, with the rudder being shown in a braking/reversing position.
Figure 8:
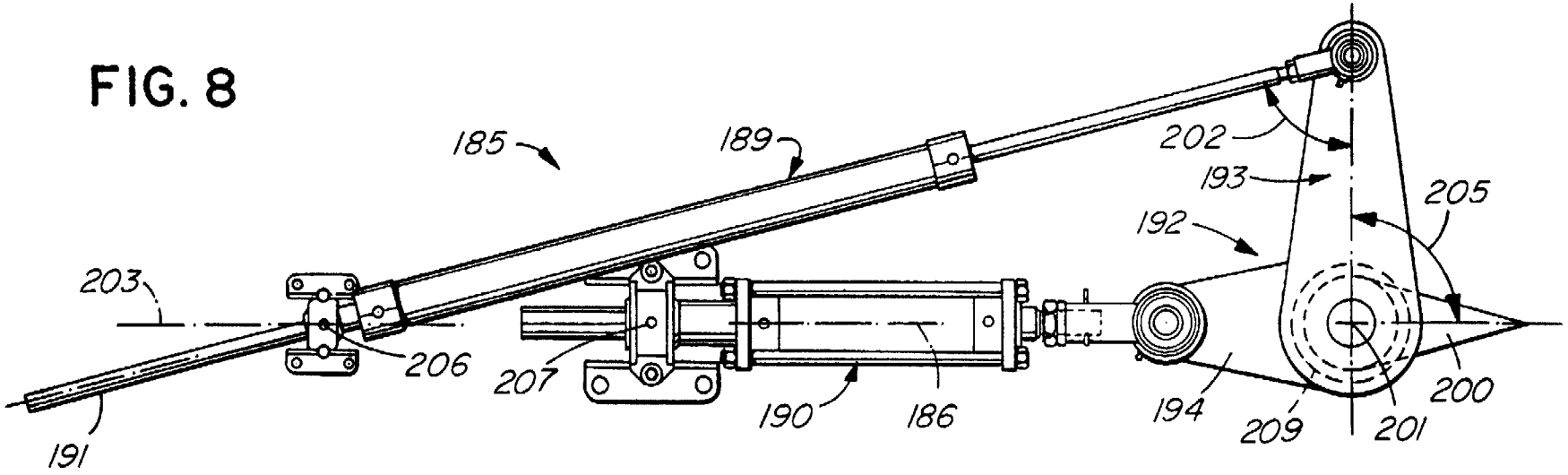
FIG. 8 is a simplified fragmented top plan of a third embodiment of the invention in which the cylinders are disposed generally aligned with the longitudinal vessel axis and cooperating with a twin tiller arm embodiment, the rudder being shown in an aligned position.
Figure 9:
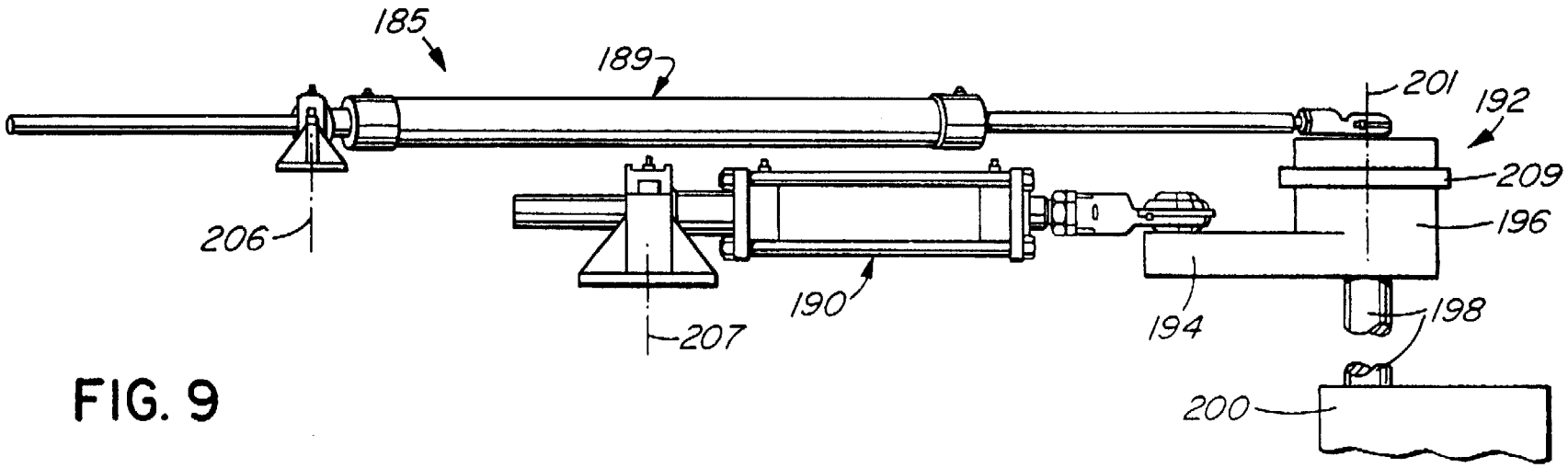
FIG. 9 is a simplified side elevation of the third embodiment of FIG. 8, the rudder being shown in the aligned position.

FIGS. 8 through 10

A third embodiment 185 of a rudder operating apparatus according to the invention has an initiating hydraulic cylinder 189 and a main hydraulic cylinder 190, the cylinders being generally similar to the cylinders 23 and 38 of FIG. 1. In contrast to the transverse location of the cylinder 23 of FIG. 1, the initiating cylinder 189 is located to be generally adjacent to the main cylinder 190, thus eliminating additional lateral space required for the transversely located initiating cylinder 23 of FIG. 1, so as to provide a more compact unit. As before, the initiating cylinders 189 and 190 serve as initiating and main linear actuators which are extensible and retractable along respective longitudinal axes 191 and 186.

The third embodiment 185 further comprises a tiller unit 192 which comprises an initiating tiller arm 193 and a main tiller arm 194 extending at fixed angles to each other and generally radially from a tiller sleeve 196 which serves as a connector portion to connect the tiller unit to an upper end of a rudder stock 198. The rudder stock extends upwardly from a rudder 200 and is journalled for rotation in stock journals (not shown) so that the rudder is journalled for rotation about a generally vertical rudder axis 201. When the rudder is in a straight position disposed generally parallel to a longitudinal vessel axis 203, a longitudinal axis 191 of the initiating cylinder 189 is disposed at an initiating angle 202 to a vertical initiating tiller plane containing the axis of the initiating tiller arm and the rudder axis 201. The main cylinder 190 similarly cooperates with the main tiller arm 194 and has a longitudinal axis 186 disposed generally within a generally vertical main tiller plane containing the main tiller arm 194 and the rudder axis 201 when the rudder axis is in the straight position. Both actuators cooperate with the rudder through the appropriate tiller arm to rotate the rudder, in sequence, as previously described. The initiating tiller plane and the main tiller plane are disposed at a tiller plane angle 205 relative to each other when viewed along the axis 201 of the rudder stock, which in this instance, is 90 degrees as the cylinders are disposed so as to rotate about cylinder hinge axes generally adjacent the longitudinal axis 203 of the vessel.

The cylinders 189 and 190 have undesignated bodies which are hinged for rotation about generally vertical initiating and main actuator hinge axes 206 and 207 respectively. The initiating and main actuator hinge axes 206 and 207 are disposed within a vertical plane containing the longitudinal axis of the main cylinder when the rudder is aligned, and thus are within the longitudinal vessel axis 203.

A controller 209 has a monitor, not shown, secured to the rudder stock 198 to rotate therewith and to transmit a signal reflecting position of the rudder relative to the longitudinal vessel axis 203. Preferably, the controller has a controller housing, not shown, generally similar to the controller housing 51 of the first embodiment, which controls actuation of directional valves communicating with the main and initiating cylinders 189 and 190. The controller thus includes valves equivalent to the valves 63 through 66 of FIGS. 4 and 5 to control sequencing and actuation of the initiating and main actuators as before described.

In operation, the third embodiment functions generally similar to the first embodiment so that, to shift the rudder from the aligned position, fluid is fed initially into the initiating cylinder 189 which extends or retracts and swings the initiating tiller arm 193 about the rudder axis 201 so as to swing the rudder 200 from the straight position. When the rudder is in the aligned position, it can be seen that the initiating cylinder applies a force to the rudder at the initiating angle 202 which is approaching an optimum, and thus a relatively small force available from the initiating cylinder does not present any problems. As the rudder approaches the switching angle, the controller supplies fluid under pressure to the main cylinder 190 which is now in a position to apply a gradually increasing torque to the rudder which is sufficient to overcome the increasing reactive force from the water, thus increasing the angle of the rudder up to 90 degrees if necessary.

What is claimed is:

1. A rudder operating apparatus for swinging a rudder of a marine vessel through approximately one half of revolution about a rudder axis, the rudder operating apparatus comprising:

(a) an initiating actuator which is connected to a tiller arm, the tiller arm cooperating with a rudder stock which controls the rudder, the actuator being adapted to initiate movement of the rudder through a switching angle from an initial position of the rudder in a straight position thereof disposed generally parallel to a longitudinal vessel axis for straight line travel, (b) a main linear actuator cooperating with the rudder stock, the main actuator being extensible and retractable along a longitudinal axis which intersects the rudder axis when the rudder is in the straight position, the main actuator being isolated from any lateral forces from the initiating actuator, and (c) a controller directly mechanically coupled to the rudder stock remotely from the main actuator so as to be responsive to position of the rudder, the controller also selectively controlling actuation of the initiating actuator and main actuator so as to actuate the initiating actuator and main actuator in sequence to swing the rudder from the straight position thereof, so that in order to swing the rudder from the straight position thereof, the initiating actuator can be actuated first to rotate the rudder through the switching angle, at which position the main actuator can apply additional force to generate sufficient torque on the rudder to increase the angle of the rudder up to approximately 90 degrees from the straight position to provide a braking force to the vessel.

2. An apparatus as claimed in claim 1, in which:

(a) the tiller arm extends from the rudder stock within a generally vertical tiller plane containing the rudder axis, (b) the rudder is located within a generally vertical rudder plane containing the rudder axis and being generally co-planar with the tiller plane, and (c) the initiating actuator is a linear actuator which is extensible and retractable along a longitudinal axis thereof and, when the rudder is in the straight position, the longitudinal axis of the linear actuator is disposed at an initiating angle to the tiller plane, the initiating angle being sufficient to enable the initiating actuator to displace the rudder from the straight position thereof through to the switching angle.

3. An apparatus as claimed in claim 1, in which the controller comprises:

(a) a monitor responsive to angle of the rudder with respect to the longitudinal vessel axis, and (b) a follower cooperating with the monitor to be responsive to the monitor, the follower having an output to actuate the initiating actuator and then the main actuator.

4. An apparatus as claimed in claim 3, in which:

(a) the rudder stock is mounted for rotation about the rudder axis, (b) the monitor is mechanical and has a cam device responsive to angle of the rudder stock, and (c) the follower is a cam follower assembly cooperating with the cam device to reflect position of the rudder stock.

5. An apparatus as claimed in claim 4, in which:

(a) the cam device comprises at least one cam having an initiating cam surface and a main cam surface spaced apart and intersecting at at least one switching zone, and (b) the cam follower assembly comprises at least one cam follower adapted to engage the cam surfaces in sequence, the switching zone of the cam surfaces being angularly phased with respect to the rudder at the switching angle so that the cam follower engages the switching zone when the rudder is at the switching angle thereof, so that as the rudder swings from the aligned position to a steering or braking position, the cam follower first engages the initiating surface, the switching zone, and then the main cam surface so that the main actuator is actuated.

6. An apparatus as claimed in claim 5, in which:

(a) the initiating and main linear actuators are fluid actuated cylinders having respective cylinder bodies and piston rods reciprocable relative thereto, the cylinder bodies being hinged for rotation about generally vertical hinge axes, and (b) the controller further comprises a fluid control valve device cooperating with the cam follower and communicating with the initiating and main cylinders to control fluid flow relative to the cylinders.

7. An apparatus as claimed in claim 6, in which:

(a) when the rudder is aligned, the control valve device permits pressurized fluid to enter the initiating cylinder to rotate the rudder towards the switching angle, and prevents exposure of the main cylinder to the pressurized fluid, and (b) when the rudder attains the switching angle, the control valve device also permits pressurized fluid to enter the main cylinder to increase the rudder angle beyond the switching angle.

8. An apparatus as claimed in claim 7, in which:

(a) the control valve device comprises at least one pair of directional valves, one valve of the pair being operable to admit pressurized fluid to the main cylinder and the other valve of the pair being operable to receive fluid returned from the main cylinder.

9. An apparatus as claimed in claim 4, in which:

(a) the cam device comprises two similar concurrently rotatable cams, each cam having an initiating cam surface and a main cam surface spaced generally diametrically apart, the cam surfaces intersecting at circumferentially spaced apart switching zones, the switching zones being phased relative to the rudder at the appropriate switching angle, and (b) the cam follower assembly comprises four cam followers arranged so that one pair of cam followers engages each of the cams, so that one switching zone of each cam is engaged by a respective cam follower when the rudder is at the switching angle.

10. An apparatus as claimed in claim 9, in which:

(a) each pair of cam followers is axially aligned on diametrically opposite sides of the cams, and (b) when the rudder is aligned with the vessel axis, the four cam followers engage axially aligned initiating surfaces.

11. An apparatus as claimed in claim 1, further comprising:

(a) a feedback signal generator cooperating with the rudder to reflect angle of the rudder with respect to the longitudinal axis, and (b) a feedback signal receiver cooperating with the feedback signal generator to display angle of the rudder to an operator.

12. An apparatus as claimed in claim 1, in which:

(a) the main actuator can generate more force than the initiating actuator.

13. An apparatus as claimed in claim 12, in which:

(a) the initiating actuator and the main linear actuator are fluid actuated cylinders exposed to essentially equal fluid pressure, and (b) the main cylinder has a greater piston area than the initiating cylinder to generate a higher force than the initiating cylinder.

14. An apparatus as claimed in claim 3, in which:

(a) the rudder is secured to the rudder stock mounted for rotation about the rudder axis, (b) the monitor includes a transmission device driven by the rudder stock, the transmission device comprising a driver unit responsive to the rudder stock, and a driven unit having a cam device reflecting movement of the rudder stock, and (c) the follower is a cam follower assembly cooperating with the cam device to reflect position of the rudder stock.

15. An apparatus as claimed in claim 1, further characterised by:

(a) said rudder being a first rudder, (b) said tiller arm being a first tiller arm extending from said rudder stock within a generally vertical first tiller plane containing the first rudder axis, (c) a second rudder spaced from the first rudder and mounted on the vessel for rotation about a second rudder axis, the second rudder having a second tiller arm which controls actuation of the second rudder, (d) a second main linear actuator cooperating with the second tiller arm, the second main linear actuator being extensible and retractable along a second longitudinal axis disposed generally within a second tiller plane when the second rudder is in the straight position, (e) the initiating linear actuator is located between the first and second tiller arms and has an initiating cylinder body and associated piston rod extending from opposite ends of the initiating cylinder body to provide a balanced cylinder, the piston rod having opposite first and second ends, and one portion of the initiating cylinder is fixed to the vessel and the other portion is movable relative thereto, and (f) first and second connecting links having inner and outer ends, the first and second inner ends being connected to the moveable portion of the initiating actuator, and the first and second outer ends being connected to the first and second tiller arms respectively, so that actuation of the initiating cylinder moves the connecting links in generally similar directions so as to apply forces to the first and second tiller arms to swing the respective rudders through essentially similar angles in the same direction to maintain the rudders generally parallel to each other.

16. An apparatus as claimed in claim 15, in which:

(a) the initiating cylinder body is fixed to the vessel and the initiating piston rod moves relative thereto.

17. A rudder operating apparatus for swinging a rudder of a marine vessel through approximately one half of a revolution about a rudder axis, the rudder operating apparatus comprising:

(a) an initiating linear actuator and an initiating tiller arm, the initiating tiller arm cooperating with the rudder to rotate the rudder, the initiating actuator cooperating with the initiating tiller arm and being extensible and retractable along a longitudinal axis disposed at a first angle to a vertical initiating tiller plane containing the initiating tiller arm and the rudder axis when the rudder is in a straight position disposed generally parallel to a longitudinal vessel axis for straight line travel, the first angle being sufficient to enable the initiating actuator to displace the rudder from the straight position thereof, (b) a main linear actuator and a main tiller arm, the main tiller arm cooperating with the rudder to rotate the rudder, the main actuator cooperating with the main tiller arm and being extensible and retractable along a longitudinal axis disposed generally within a generally vertical main tiller plane containing the main tiller arm and the rudder axis when the rudder axis is in the straight position, and (c) a controller responsive to position of the rudder and cooperating with the initiating actuator and the main actuator to actuate the initiating and main actuators in sequence to swing the rudder from the straight position thereof, so that in order to swing the rudder from the straight position thereof, the initiating actuator can be actuated first to rotate the rudder through a switching angle, at which position the main actuator can be actuated to apply additional force to the tiller arm ahd sufficient torque to the rudder to increase the rudder angle up to approximately 90 degrees from the straight position to provide a braking force to the vessel.

18. An apparatus is claimed in claim 17, further comprising:

(a) a rudder stock concentric with the rudder axis and cooperating with the rudder to permit the rudder to swing through approximately one-half of a revolution, the rudder stock carrying the initiating tiller arm and the main tiller arm, and in which:

(b) the initiating tiller arm plane and the main tiller plane are disposed at a tiller plane angle relative to each other when viewed along the axis of the rudder stock.

19. An apparatus as claimed in claim 18, in which:

(a) the initiating tiller arm and the main tiller extend from a connector portion to form a tiller unit which is mounted at an upper end of the rudder stock.

20. An apparatus as claimed in claim 18, in which:

(a) the tiller plane angle is about 90 degrees.

21. An apparatus as claimed in claim 17, in which:

(a) the initiating and main actuators are hinged for rotation about generally vertical initiating and main actuator hinge axes respectively, which hinge axes are disposed within a generally vertical plane.

22. An apparatus as claimed in claim 21, in which:

(a) the initiating and main actuator hinge axes are disposed within a plane containing the longitudinal axis of the main cylinder when the rudder is aligned.

23. A rudder operating apparatus for swinging a rudder of a marine vessel through approximately one half of revolution about a rudder axis, the rudder operating apparatus comprising:

(a) an initiating actuator cooperating with a rudder stock which controls the rudder, the rudder stock being mounted for rotation about the rudder axis, the actuator being adapted to initiate movement of the rudder through a switching angle when the rudder is in a straight position thereof disposed generally parallel to a longitudinal vessel axis for straight line travel, (b) a main linear actuator cooperating with the rudder stock, the main actuator being extensible and retractable along a longitudinal axis which intersects the rudder axis when the rudder is in the straight position, and (c) a controller responsive to position of the rudder and cooperating with the initiating actuator and main actuator to actuate the initiating actuator and main actuator in sequence to swing the rudder from the straight position thereof, the controller comprising a mechanical monitor and a follower, the mechanical monitor being a cam device responsive to angle of the rudder stock with respect to the longitudinal vessel axis, and the follower being a cam follower assembly cooperating with the cam device to be responsive to the monitor to reflect position of the rudder stock, the follower having an output to actuate the initiating actuator and then the main actuator, so that in order to swing the rudder from the straight position thereof, the initiating actuator can be actuated first to rotate the rudder through the switching angle, at which position the main actuator can apply additional force to generate sufficient torque on the rudder to increase the angle of the rudder up to approximately 90 degrees from the straight position to provide a reversing force to the vessel.

24. An apparatus as claimed in claim 23, in which:

(a) the cam device comprises at least one cam having an initiating cam surface and a main cam surface spaced apart and intersecting at at least one switching zone, and (b) the cam follower assembly comprises at least one cam follower adapted to engage the cam surfaces in sequence, the switching zone of the cam surfaces being angularly phased with respect to the rudder at the switching angle so that the cam follower engages the switching zone when the rudder is at the switching angle thereof, so that as the rudder swings from the aligned position to a steering or braking position, the cam follower first engages the initiating surface, the switching zone, and then the main cam surface so that the main actuator is actuated.

25. An apparatus as claimed in claim 24, in which:

(a) the initiating and main linear actuators are fluid actuated cylinders having respective cylinder bodies and piston rods reciprocal relative thereto, the cylinder bodies being hinged for rotation about generally vertical hinge axes, and (b) the controller further comprises a fluid control valve device cooperating with the cam follower and communicating with the initiating and main cylinders to control fluid flow relative to the cylinders.

26. An apparatus as claimed in claim 25, in which:

(a) when the rudder is aligned, the control valve device permits pressurizing fluid to enter the initiating cylinder to rotate the rudder towards the switching angle, and prevents exposure of the main cylinder to the pressurized fluid, and (b) when the rudder attains the switching angle, the control valve device also permits pressurized fluid to enter the main cylinder to increase the rudder angle beyond the switching angle.

27. An apparatus as claimed in claim 26, in which:

(a) the control valve device comprises at least one pair of directional valves, one valve of the pair being operable to admit pressurized fluid to the main cylinder and the other valve of the pair being operable to receive fluid returned from the main cylinder.

28. An apparatus in claim 23, in which:

(a) the cam device comprises two similar concurrently rotatable cams, each cam having an initiating cam surface and a main cam surface spaced generally diametrically apart, the cam surfaces intersecting at circumferentially spaced apart switching zones, the switching zones being phased relative to the rudder at the appropriate switching angle, and (b) the cam follower assembly comprises four cam followers arranged so that one pair of cam followers engages each of the cams, so that one switching zone of each cam is engaged by a respective cam follower when the rudder is at the switching angle.

29. An apparatus as claimed in claim 23, in which:

(a) each pair of cam followers is axially aligned on diametrically opposite sides of the cams, and (b) when the rudder is aligned with the vessel axis, the four cam followers engage axially aligned initiating surfaces.

30. An apparatus as claimed in claim 23 in which:

(a) the mechanical monitor is a transmission device driven by the rudder stock, the transmission device comprising a driver unit responsive to the rudder stock, and a driver unit having the cam device reflecting movement of the rudder stock.

* * * * *